United States Patent [19]

Maier et al.

[11] Patent Number: 4,897,182

[45] Date of Patent: Jan. 30, 1990

[54] AROMATIC EXTRACTION PROCESS HAVING IMPROVED WATER STRIPPER

[75] Inventors: William H. Maier, Hoffman Estates; Martin F. Bentham, Chicago, both of Ill.

[73] Assignee: UOP, Des Plaines, Ill.

[21] Appl. No.: 252,616

[22] Filed: Oct. 3, 1988

[51] Int. Cl.[4] ..... C10G 21/28

[52] U.S. Cl. ..... 208/321; 208/325

[58] Field of Search ..... 208/321, 325

[56] References Cited

U.S. PATENT DOCUMENTS

| | | | |
|---|---|---|---|
| 3,179,708 | 4/1965 | Penisten | 208/321 |
| 3,551,327 | 12/1970 | Kelly et al. | 208/321 X |
| 3,652,452 | 3/1972 | Eyermann | 208/321 |
| 3,864,244 | 2/1975 | Van tassell | 208/321 |
| 3,864,245 | 2/1975 | Van Tassell | 208/321 |
| 4,046,675 | 9/1977 | Asselin | 208/321 |
| 4,058,454 | 11/1977 | Asselin | 208/321 |
| 4,781,820 | 11/1988 | Forte | 208/321 X |

*Primary Examiner*—Glenn Caldarola

*Attorney, Agent, or Firm*—Thomas K. McBride; John G. Tolomei

[57] ABSTRACT

An improved process for the extraction of aromatics from a mixed feed provides additional flexibility of operation which is especially useful when the feed contains relatively large amounts of nonaromatics and therefore produces a large raffinate stream. Water for washing the non-aromatic raffinate is obtained in part by condensing a portion of the steam generated for stripping aromatics from the extract.

3 Claims, 1 Drawing Sheet

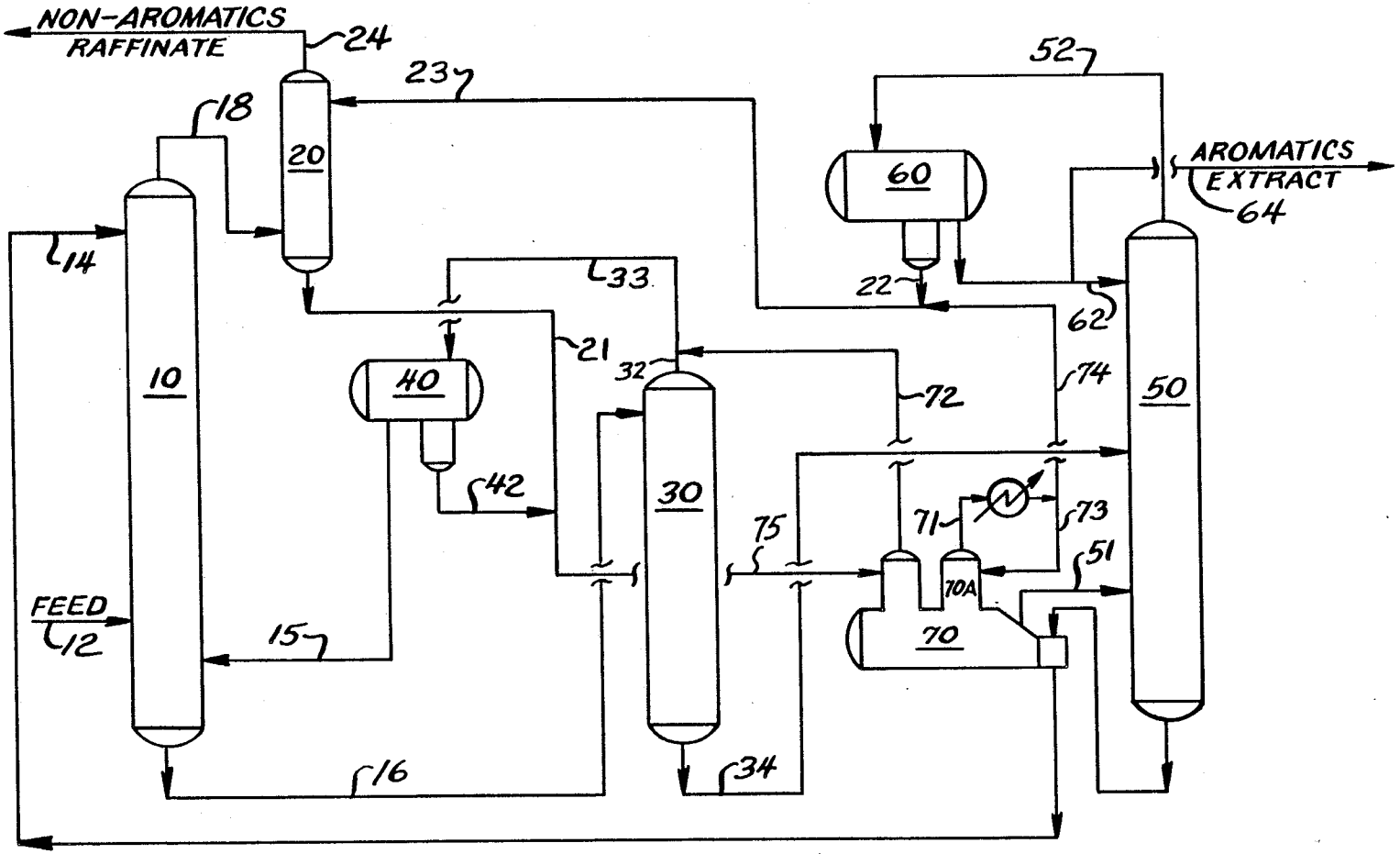
AROMATICS EXTRACT
64
50
52
62
74
73
51
60
22
72
71
70A
70
75
34
30
32
33
21
42
40
23
24
20
18
15
16
10
NON-AROMATICS RAFFINATE
14
FEED
12

AROMATIC EXTRACTION PROCESS HAVING IMPROVED WATER STRIPPER

This invention relates generally to aromatics extraction processes, particularly to processes which separate aromatics from mixed hydrocarbon feedstocks using solvents such as sulfolanes—more especially to processes which extract aromatics from feeds having 15–90% nonaromatics.

PRIOR ART

Highly selective solvents such as sulfolanes are capable of providing a sharp separation between aromatics and non-aromatics. Very pure aromatics are obtained by stripping residual nonaromatics from the rich extract and then distilling the aromatics away from the solvent. Steam is typically used to assist in rejecting hydrocarbons from the solvent. The steam is condensed with the aromatics product, separated and used to wash the non-aromatic raffinate. Used wash water containing some hydrocarbons is vaporized and reused as stripping steam, with the hydrocarbons being separated before steam is generated.

The process summarized above is shown in copending patent application U.S.S.N. 192,018 and will be described in more detail later. For introductory purposes, the path of the water circulating in the process may be briefly summarized as follows. Stripping steam added to the aromatics recovery column is condensed along with the aromatics products. A portion remains dissolved in the aromatics product while the remainder is phase-separated in the distillation column overhead drum. The separated water is sent to the wash column where it scrubs residual solvent from the nonaromatic raffinate. The used water leaving the water wash column is sent to the stripping steam generator, along with water phase-separated from the extract stripping column overhead vapor. Since the combined water stream contains undesirable amounts of hydrocarbons, it is stripped as it enters the steam generator; the hydrocarbon vapors are combined with the extract stripper overhead vapor, condensed and phase-separated. The relatively pure steam generated is sent to the distillation column to strip the solvent of aromatics, thus completing the cycle.

A similar flowsheet is shown in U.S. Pat. No. 4,058,454, which relates to an improvement in the extraction step. Water for washing the raffinate comes from the condensed stripping steam as described above.

A different extraction process is shown in U.S. Pat. No. 3,652,452. The patent is generally concerned with preventing finely dispersed particles of solvent from being carried into the wash column. In that process, the used wash water is distilled to remove the solvent and the distilled water is recycled to the wash column. The process employs no stripping column for removal of residual nonaromatics and has only one distillation column to separate aromatics from the solvent, which does not use stripping steam and consequently the process includes no steam generator.

Another process is disclosed in U.S. Pat. No. 3,864,244 which employs a steam generator to supply stripping steam but which uses only one distillation column to separate nonaromatics from aromatics and from solvent. The stripping steam is condensed with the aromatics product (drawn as a sidestream) and after phase separation is sent to the wash column. Some of the steam passes overhead in the distillation column and is condensed with the nonaromatics. The phase-separated water is combined with the used wash water and vaporized to generate stripping steam for the aromatics distillation. The process relates to the contacting of the used wash water with a portion of the aromatics product to remove the nonaromatic contaminants before steam is generated.

It has been found that when a relatively lean feed is extracted (i.e. it contains a large amount of nonaromatics) that the conventional water flows described above and in S.N. 192,018 are inadequate. A large nonaromatic raffinate stream requires an unusually large amount of wash water. In the conventional process all of this water comes from the stripping steam condensed with the aromatics product, but when more water is needed than steam is required for stripping, operation of the column in this manner becomes uneconomic. Consequently, an improved process was found by the inventors and will be discussed in detail below.

SUMMARY OF THE INVENTION

An improved process for the extraction of aromatics from a feed containing both aromatic and nonaromatic hydrocarbons provides additional flexibility of operation especially useful where the feedstream contains relatively large amounts of nonaromatics. The process includes the following steps common to many of such processes:

(a) the feed is contacted with a solvent selective for aromatic hydrocarbons to provide a raffinate comprising substantially only nonaromatic hydrocarbons and an extract comprising substantially all of the aromatic hydrocarbons and a minor fraction of the nonaromatic hydrocarbons;

(b) the raffinate is washed with a water wash stream;

(c) nonaromatic hydrocarbons are stripped from the extract, then condensed and recycled to the extraction step (a);

(d) the stripped extract is distilled in the presence of steam to recover the aromatic hydrocarbons and to separate the solvent for reuse;

(e) the stripping steam used in the distillation of (d) is condensed along with the aromatics, phase separated, and then used as the wash water in (b);

(f) the wash water after washing the non-aromatic raffinate is combined with water separated from the condensed nonaromatic hydrocarbons of step (c) and then used to generate steam;

(g) the hydrocarbons contained in the steam generator feed water are stripped as they enter the steam generator and combined with the nonaromatic hydrocarbons stripped from the extract in step (c);

(h) steam is generated and supplied to the aromatic product distillation of step (d).

The improved process includes the following steps not common with previous processes.

(i) a portion of the steam generated in step (h) is condensed and refluxed to purify the condensed water; and, (j) a portion of the condensed water produced in step (i) is withdrawn and used as water wash in step (b) in combination with the condensed water produced in step (e).

BRIEF DESCRIPTION OF THE DRAWINGS

The sole figure is a simplified flowsheet of a typical aromatics extraction process of the invention.

DESCRIPTION OF THE PREFERRED EMBODIMENTS

The invention is best understood by first considering the separation of a feedstock containing a significant fraction of aromatic compounds. The aromatic and nonaromatic hydrocarbons in the feedstock are separated almost completely with high purities. A feature of this process is that the solvent which is used for extraction is very efficient and is retained almost entirely within the separation system, requiring very little makeup of fresh solvent, although some must be purged and purified before reuse. Typically, the process uses sulfolanes as a solvent, however, other solvents of a similar nature may be used such as polyglycols, dimethyl sulfoxide, N-formyl morpholine and the like.

The process is illustrated in a simplified form in the figure in which only the major vessels used in the process are shown. It is to be understood that in any detailed flowsheet many more pieces of equipment and instrumentation will be necessary. As seen in the figure, feedstock 12 is supplied to the bottom of an extraction column 10 which may be a rotating disc contactor, or a column using trays, packing or the like. A lean solvent stream 14 is passed countercurrently to the feed. The solvent stream will consist primarily of the extracting solvent, such as sulfolane, but including also minor amounts of water and any residual hydrocarbons which are not removed in the recovery column 50. The solvent enters the top of the extraction column 10 and passes downward while contacting the feedstream so that at the bottom of column 10 what was previously termed a lean solvent has become aromatics-rich solvent 16. The hydrocarbon concentration in the solvent may be quite substantial, and typically is in the range of 18 to 45 volume percent.

The feedstream gives up its aromatics as it passes upward against the downflowing solvent and at the top of the column substantially only nonaromatic compounds remain. However, they will contain a small amount of solvent which should be recovered. Consequently, the nonaromatic stream 18 is scrubbed in raffinate water wash column 20 countercurrently against a circulating stream of water 22 which is described in more detail later. The scrubbed product stream 24 is termed the raffinate. It comprises substantially all of the nonaromatic compounds introduced with the feed with very little residual solvent, say 5 ppm, and substantially no aromatic compounds when the process is operated efficiently.

Another stream (15) which will be discussed in more detail later enters near the bottom of the extraction column 10. It is a recirculating stream which contains a substantial fraction of aromatics but more importantly, contains nonaromatic compounds which are purged from the aromatics-rich solvent in stripper 30 in order to avoid contaminating the aromatics product 64. This stream 15 is introduced toward the bottom of column 10 where it displaces the heavier nonaromatic components so that they pass up the column and out with the raffinate stream 24.

The aromatics-rich solvent 16 is passed to a reboiled stripping column 30 where the minor amounts of nonaromatic compounds which are present in the aromatics-rich extract are rejected. Stripping column 30 is important in maintaining the purity of the aromatics product 64, which may easily be above 99 percent aromatics. In order to remove the minor amounts of nonaromatics, it is necessary to remove overhead a portion of the lighter aromatics, particularly benzene, as well. The overhead vapor stream 32 from stripping column 30 is cooled and condensed and phase-separated in vessel 40. The hydrocarbons are recycled as stream 15 to the extraction column 10 as previously mentioned. Since water is present in the solvent as it enters the extractor, water also appears in the overhead vapor 32 of the stripping column 30 and when condensed separates from the hydrocarbons and returned via stream 42 to water-handling facilities to be discussed later.

The aromatics-rich solvent leaving as stream 34 from the bottom of the stripping column 30 now is substantially free of nonaromatic compounds and is ready for separation of the aromatics from the solvent which takes place by distillation in recovery column 50. Column 50 is reboiled to generate stripping vapor and the overhead vapor 52 is condensed. A portion of the condensate is drawn off as the aromatics extract product 64. A portion of the hydrocarbon condensate is returned as reflux 62 to the column to maintain the desired degree of separation of aromatics from solvent. Stripping steam 51 is introduced toward the bottom of the column 50 in order to strip out the aromatics and to reduce the solubility of hydrocarbons in the solvent and consequently to lower their concentration in the lean solvent which is to be reused for extraction. The steam is generated from water obtained from two sources, the first being the water (21) leaving the raffinate water wash column 20. The second is the water condensed and separated from the stripper overhead (42). These two streams will contain a minor amount of hydrocarbons. In order to avoid contamination of the solvent, the combined water streams 75 are stripped in water stripper 70 to provide an essentially hydrocarbon-free water for use as stripping steam 51 in the recovery column 50. The hydrocarbons recovered (72) are combined with the stripper overhead 32 to create stream 33. The overhead vapor 52 from recovery column 50 is cooled and condensed. A hydrocarbon portion is separated as product (64) and another portion recycled as reflux (62) to the recovery column as previously mentioned. In addition, water present in overhead vapor 52 is condensed to liquid water which is separated in vessel 60 and then returned to the raffinate water wash column 20 via stream 22 as a means of removing trace solvent from the raffinate as previously explained.

It can be seen that the overall process is one in which a mixed hydrocarbon feedstock (12) containing significant amount of aromatic hydrocarbons is split into a nonaromatic raffinate (24) and an aromatic hydrocarbon extract (64). The solvent circulates from the extraction column 10 to the stripping column 30, then to the recovery column 50, and back to extraction column 10 again. Since sulfolane is a particularly stable material under the conditions in which it is used in this process only a minor purge is required in order to rid the stream of any buildup of heavy compounds or degradation products. This is not shown in the flowsheet since it is only incidental to the process of the invention. Water also circulates continuously through the process, being used to wash the raffinate free of solvent in column 20 and to supply stripping vapor for use in recovery column 50 to remove hydrocarbons from the solvent before it is reused in extraction column 10.

When the feedstream (12) contains a relatively large amount of nonaromatics, say 55–90 volume %, the raffinate stream 18 is much larger and wash water stream 22 must be increased to assure complete removal of the sulfolane (or other solvent if used). In the usual process this wash water is obtained by phase-separating the condensed overhead vapor 52 from the product recovery column 50 as previously described. When the aromatic content of the extract is relatively low, the increased demand for wash water (22) exceeds the need for stripping steam (51) to purify the solvent before reuse. Increasing the stripping steam also would require greater reflux (62) to column 50 especially where the product contains a large amount of benzene in order to avoid condensation of water on the trays. In the present invention, a portion of the wash water (22) is obtained by withdrawing steam (71) from the stream generator 70 after contacting a water reflux stream 73 in contacting section 70*a*. The withdrawn steam is condensed and part of the water is returned as reflux (73) and a portion (74) is combined with water (22) from drum 60 to create stream 23 and to augment the supply of wash water for use in wash column 20.

The wash water must be relatively free of hydrocarbons and consequently a reflux to steam ratio (73/71) of about 0.03 to 0.6 is used. The contacting section 70a may be packed with suitable packing materials such as rings, saddles, etc. known to those skilled in the art or alternatively trays or other familiar contacting devices may be employed.

We claim:

1. A process for the extraction of aromatics from a feed containing both aromatic and nonaromatic hydrocarbons comprising:

(a) contacting said feed with a solvent selective for aromatic hydrocarbons and separating a raffinate comprising substantially only nonaromatic hydrocarbons and an extract comprising substantially all of the aromatic hydrocarbons and a minor fraction of the nonaromatic hydrocarbons;

(b) washing the raffinate of (a) with a wash water stream;

(c) stripping the nonaromatic hydrocarbons from the extract of (a), condensing and returning said stripped nonaromatic hydrocarbons to the extraction of (a) and condensing and phase separating the steam containing stripped hydrocarbons of (g) below;

(d) recovering the aromatic hydrocarbons from the stripped extract from (c) by steam stripping and condensing and phase separating said stripped aromatics and steam;

(e) recycling said condensed steam of (d) as the wash water stream to (b);

(f) separating the wash water stream after contact with the raffinate in (b) and supplying said water stream as feed to a stripping steam generator in combination with the phase separated condensed steam of (c);

(g) stripping residual hydrocarbons from the stripping steam generator feed with steam at the entrance to the steam generator and combining said stripped hydrocarbons and steam with the stripped nonaromatic hydrocarbons of (c);

(h) generating steam in the steam generator of (f) and using a portion of said steam in (d);

(i) condensing a portion of the steam generated in (h) and returning a portion of the condensate as reflux to purify the condensed water; and, (j) sending the remaining portion of the condensate of (i) to the wash step of (b) in combination with the condensed steam of (e).

2. The process of claim 1 wherein the reflux to steam ratio in step (i) is about 0.03 to 0.6.

3. The process of claim 1 wherein said solvent is a sulfolane.

* * * * *